United States Patent [19]

Obayashi et al.

[11] 4,282,785

[45] Aug. 11, 1981

[54] ELECTRONIC MUSICAL INSTRUMENT

[75] Inventors: Nobuharu Obayashi, Kami; Hikaru Hashizume, Hamamatsu; Seiji Kameyama, Hamamatsu; Sadaaki Ezawa, Hamamatsu; Tatsunori Kondo, Hamamatsu; Kiyomi Takauji, Hamamatsu; Tohru Aoyama, Hamamatsu, all of Japan

[73] Assignee: Kabushiki Kaisha Kawai Gakki Seisakusho, Hamamatsu, Japan

[21] Appl. No.: 842,525

[22] Filed: Oct. 17, 1977

[51] Int. Cl.[3] ..... G10H 1/00; G10F 1/00; G10H 1/04

[52] U.S. Cl. ..... 84/1.01; 84/1.03; 84/1.25; 84/DIG. 11

[58] Field of Search ..... 84/1.25, 1.01, 1.03, 84/DIG. 11, DIG. 20

[56] References Cited

U.S. PATENT DOCUMENTS

| | | | |
|---|---|---|---|
| 3,610,799 | 10/1969 | Watson | 84/1.01 |
| 3,610,800 | 10/1971 | Deutsch | 84/1.01 |
| 3,842,702 | 10/1974 | Tsundoo | 84/1.01 |
| 4,063,484 | 12/1977 | Robinson | 84/1.24 |
| 4,067,254 | 1/1978 | Deutsch et al. | 84/1.01 |
| 4,114,496 | 9/1978 | Deutsch | 84/1.1 |

OTHER PUBLICATIONS

S. H. Dolding, Musical Octave Note Synthesiser, Electronics Australia, vol. 36, No. 2, pp. 44–45, May 1974.

*Primary Examiner*—J. V. Truhe
*Assistant Examiner*—John B. Conklin

[57] ABSTRACT

An electronic musical instrument which is provided with a note frequency data memory for storing note frequency data corresponding to data of key switch depression through a key code register, a note frequency data register for latching and storing the data from the note frequency data memory by a time division pulse from a time division control signal generator, an octave data register for latching and storing octave data from the key code register by the time division pulse from the time division control signal generator, a frequency generator composed of a programmable counter supplied with the output from the note frequency data register to provide a frequency corresponding thereto, a frequency divider array supplied with the frequency and a decoder supplied with the output from the octave data register, the outputs from the respective output ends of the frequency divider array being selected by the output from the decoder in accordance with the octave data, and a musical waveform generator composed of filter circuits corresponding to respective musical instrument sounds and supplied with the output from the frequency generator to provide a musical signal.

3 Claims, 6 Drawing Figures

ELECTRONIC MUSICAL INSTRUMENT

BACKGROUND OF THE INVENTION

1. Field of the Invention

This invention relates to an electronic musical instrument, and more particularly to an electronic musical instrument of the system in which frequencies related to those of sounds produced are provided by a time sharing control in channels provided corresponding to a limited number of sounds to be produced simultaneously.

2. Description of the Prior Art

Heretofore, there have been proposed electronic musical instruments of the digital system in U.S. Pat. No. 3,515,792 entitled "Digital Organ" and in U.S. Pat. No. 3,809,786 entitled "Computor Organ". In the former, one cycle of a required musical waveform is quantized by sampling and stored in a read-only memory and the content of the read-only memory is read out repetitiously by one or more clocks corresponding to a keyboard or keyboards and multiplied or divided by an envelope waveshape stored in the read-only memory. In the latter, a discrete Fourier algorithm is implemented to compute each amplitude from a stored set of harmonic coefficients $C_n$ and a selected frequency member R. In more detail, the computations occur at regular time intervals independent of the waveshape period and the waveshape sample point qR (q=1, 2, 3, . . . ) is computed by a note interval adder from the frequency number R corresponding to the key depressed. Further, W harmonics are read out by a harmonic interval adder from the note interval adder and is multiplied by the stored harmonic coefficients $C_n$ representing features of the musical waveshape to calculate $C_n\sin(\pi nqR/W)$ (n=1, 2, 3, . . . , W). These calculations are carried out in real time, so that the musical waveshape is obtained in real time.

These two methods have the following defects. With the former method, since the musical waveshape is stored in a read-only memory, its stored content is not easy to change and, for obtaining many musical waveshapes, it is necessary to provide many memories corresponding to desired musical waveshapes, respectively. As compared with the above method, the latter method has the advantage that a desired musical waveshape can be synthesized, but since the calculations are achieved in real time, the computor organ of this method requires a very high clock frequency.

For example, for generation of harmonics up to 32nd one with respect to a note having a note frequency of 2.093 KHz ($C_7$) at the highest, used in the computor organ, the clock frequency required is 4.29 MHz in a single channel. In a polyphonic tone synthesizing system in which note data are time shared by using a single computation channel corresponding to twelve notes, the clock frequency becomes as high as 51.43 MHz. Therefore, integration of this system is difficult and is not advisable from the economical point of view.

In connection with the latter system, there have been proposed various musical waveshape synthesizing methods. But many of these methods usually employ analog processing in combination with digital processing and an error occurs in relation to frequency and the use of a D-C converter and so on leads to an increase in the manufacturing cost of electronic musical instruments.

SUMMARY OF THE INVENTION

This invention has for its object to provide a digital electronic musical instrument which is free from the abovesaid defects of the prior art and which electronically synthesizes a polyphonic tone and is simple in construction and is of few frequency error.

To achieve the abovesaid object, the electronic musical instrument of this invention comprises a note frequency data memory for storing note frequency data corresponding to data of key switch depression through a key code register, a note frequency data register for latching and storing the data from the note frequency data memory by a time division pulse from a time division control signal generator, an octave data register for latching and storing octave data from the key code register by the time division pulse from the time division control signal generator, a frequency generator composed of a programmable counter supplied with the output from the note frequency data register to provide a frequency corresponding thereto, a frequency divider array supplied with the frequency and a decoder supplied with the output from the octave data register, the outputs from the respective output ends of the frequency divider array being selected by the output from the decoder in accordance with the octave data, and a musical waveform generator composed of filter circuits corresponding to respective musical instrument sounds and supplied with the output from the frequency generator to provide a musical signal.

DESCRIPTION OF THE PREFERRED EMBODIMENTS

Figure 1:
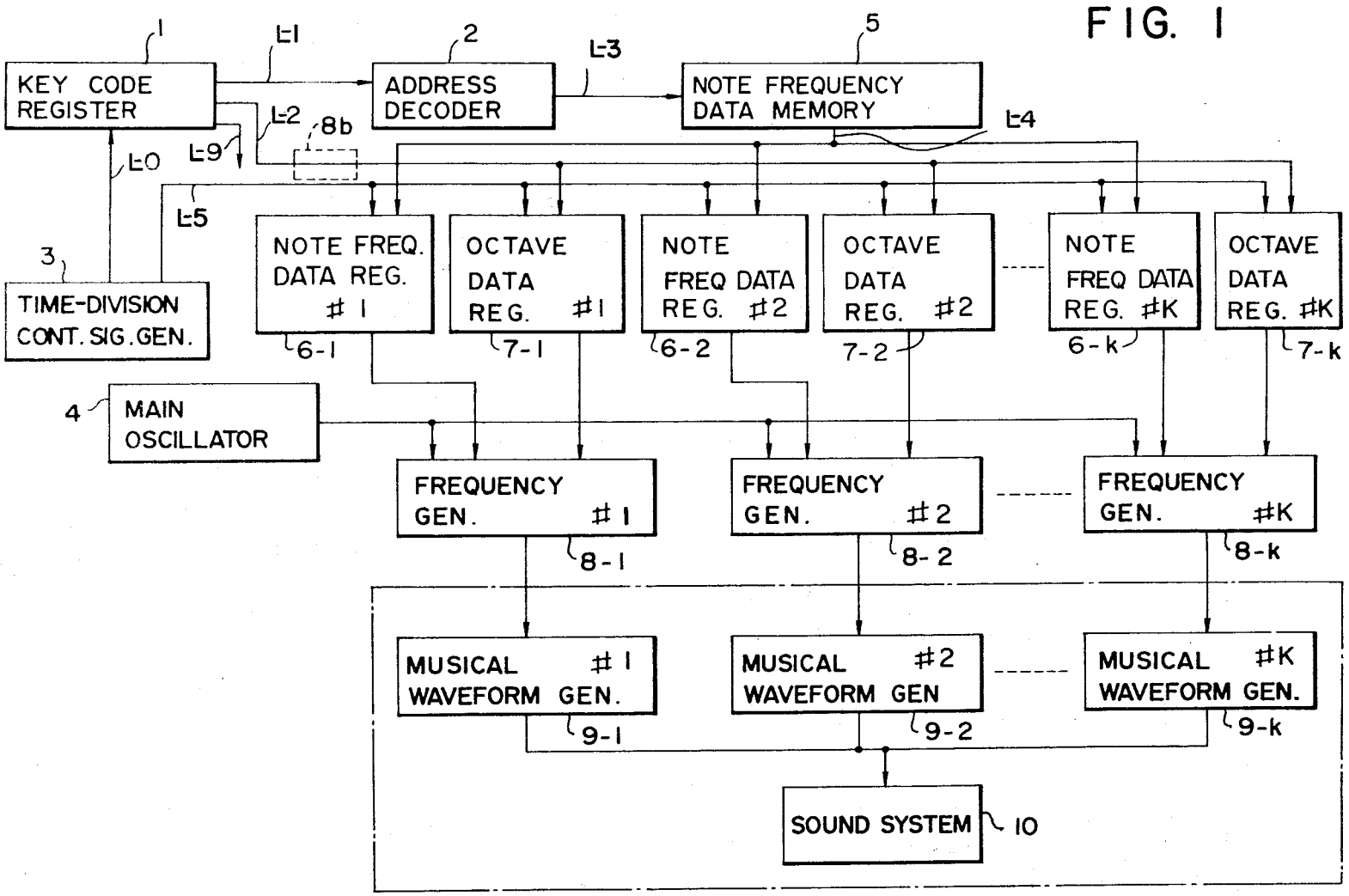
FIG. 1 is an explanatory diagram showing the construction of an embodiment of this invention.

FIG. 1 illustrates in block form the construction of an embodiment of this invention. In FIG. 1, a key code register 1 has a construction of a random access memory (10 bits×k words) such, for example, as shown in the following Table 1.

TABLE 1

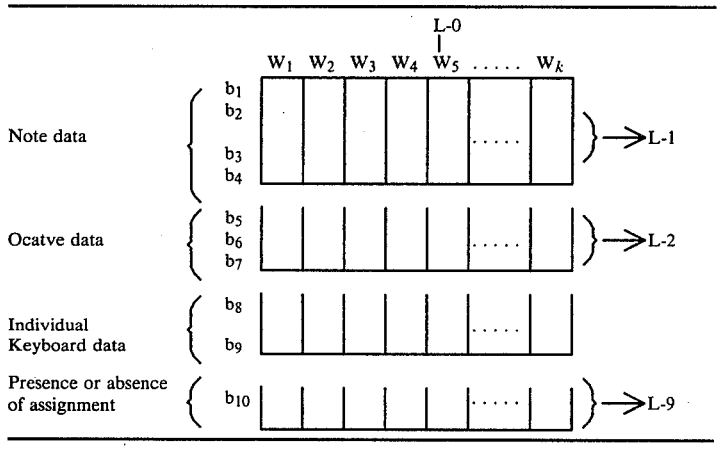

The key code register 1 performs an operation of storing therein, at address positions $W_1$ to $W_k$ provided corresponding to channels, respectively, depressed key information supplied from a separately provided key assignor circuit in accordance with key switches opened and closed by performance, though not shown, and an operation of reading out note data $b_1$ to $b_4$ on the line L-1, octave data $b_5$ to $b_7$ on the line L-2 and data indicating the presence or absence of address assignment (presence of assignment: occupied, absence of assignment: not occupied) on the line L-9 in accordance with the address assignment corresponding to a time dividing control signal from the line L-0 connected to the output of a time division control signal generator 3. The abovesaid data indicating the presence or absence of address assignment is a signal which indicates whether the channel of the address hunted by the key assignor circuit is already occupied or not when the key assignor circuit looks for an empty channel.

The note data provided on the line L-1 are converted by an address decoder 2 to an address signal. The address signal is supplied via a line L-3 to a note frequency data memory 5 to provide therefrom the corresponding note frequency data on a line L-4. In the note frequency data memory 5, the binary data $Q_1$, $Q_2$, . . . corresponding to the number of frequencies divided are stored as $D_C$ to $D_{C\#}$ corresponding to twelve notes, as shown in the following Table 2.

TABLE 2

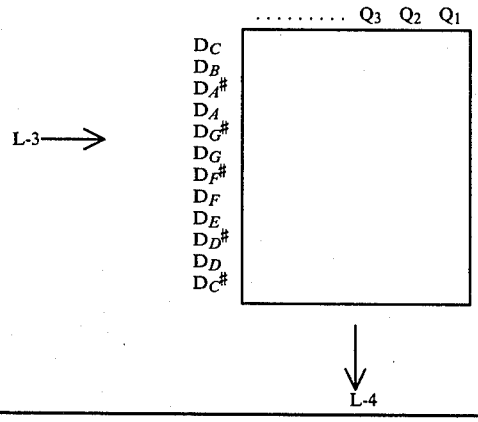

The time division control signal generator 3 is comprised of a clock generator, a k-step counter for counting the output therefrom and a decoder for decoding the output from the k-step counter into k time division pulse signals; namely, the time division signal from the k-step counter, corresponding to the address assignment on the line L-0, is provided on the line L-5 from the decoder. That is, the time division control signal generator 3 sends out the signal to a note frequency data register (#1)6-1 and an octave data register (#1)7-1 in the case of the address $W_1$ being assigned by the address assignment on the line L-0, and to a note frequency data register (#2)6-2 and an octave data register (#2)7-2 in the case of the address $W_2$. Thereafter, the time division control signal generator 3 similarly provides via the line L-5 to the other note frequency data registers and octave data registers in the cases of assignment of the other addresses. With the abovesaid signal, the octave data on the line L-2 and the note frequency data on the line L-4 corresponding to the content of the address $W_1$ are stored in the octave data register (#1)7-1 and the note frequency data register (#1)6-1, respectively. In a likewise manner, the octave data on the line L-2 and the note frequency data on the line L-4 corresponding to the addresses $W_2$ to $W_k$ are stored in the octave data registers 7-2 to 7-k and the note frequency data registers 6-2 to 6-k, respectively. The data from the note frequency data register (#1)6-1 and the octave data register (#1)7-1 are both applied to a frequency generator 8-1. Similarly, the data from the note frequency data registers 6-2 to 6-k and the octave data registers 7-2 to 7-k are applied to frequency generators 8-2 to 8-k, respectively.

The outputs from the frequency generators (#1)8-1 to (#k) 8-k are applied to musical waveform generators (#1)9-1 to (#k)9-k, respectively. The musical waveform generators (#1)9-1 to (#k) 9-k are each formed with a tone filter or a memory having stored therein a musical waveform after discretely sampling and converting it to a digital value. In this case, such an arrangement is necessary that the frequency generators 8-1 to 8-k each provide the note frequency or (note frequency)×(sample number) depending upon whether the musical waveform generators 9-1 to 9-k are each the aforesaid tone filter or memory.

A detailed description will hereinafter be given of the embodiment of this invention on the assumption of the numerical values shown in the following Tables 3 and 4.

TABLE 3

| | Note data | | | | | Octave data | | | Individual keyboard data | | | Presence or absence of assignment | |
|---|---|---|---|---|---|---|---|---|---|---|---|---|---|
| | $b_4$ | $b_3$ | $b_2$ | $b_1$ | | $b_7$ | $b_6$ | $b_5$ | | $b_9$ | $b_8$ | | $b_{10}$ |
| C | 1 | 1 | 0 | 0 | $C_8 \sim C_7^{\#}$ | 1 | 1 | 1 | Upper keyboard | 1 | 1 | Presence | 1 |
| B | 1 | 0 | 1 | 1 | $C_7 \sim C_6^{\#}$ | 1 | 1 | 0 | Lower keyboard | 1 | 0 | Absence | 0 |
| $A^{\#}$ | 1 | 0 | 1 | 0 | $C_6 \sim C_5^{\#}$ | 1 | 0 | 1 | Pedal keyboard | 0 | 1 | | |
| A | 1 | 0 | 0 | 1 | $C_5 \sim C_4^{\#}$ | 1 | 0 | 0 | | | | | |
| $G^{\#}$ | 1 | 0 | 0 | 0 | $C_4 \sim C_3^{\#}$ | 0 | 1 | 1 | | | | | |
| G | 0 | 1 | 1 | 1 | $C_3 \sim C_2^{\#}$ | 0 | 1 | 0 | | | | | |
| $F^{\#}$ | 0 | 1 | 1 | 0 | $C_2 \sim C_1^{\#}$ | 0 | 0 | 1 | | | | | |
| F | 0 | 1 | 0 | 1 | | | | | | | | | |
| E | 0 | 1 | 0 | 0 | | | | | | | | | |
| $D^{\#}$ | 0 | 0 | 1 | 1 | | | | | | | | | |
| D | 0 | 0 | 1 | 0 | | | | | | | | | |
| $C^{\#}$ | 0 | 0 | 0 | 1 | | | | | | | | | |

TABLE 4

| | $Q_9$ | $Q_8$ | $Q_7$ | $Q_6$ | $Q_5$ | $Q_4$ | $Q_3$ | $Q_2$ | $Q_1$ | Decimal representation | fm/D[$H_2$'] |
|---|---|---|---|---|---|---|---|---|---|---|---|
| $D_C$ | 0 | 1 | 1 | 1 | 1 | 1 | 1 | 0 | 1 | 253 | 4187.8 |
| $D_B$ | 1 | 0 | 0 | 0 | 0 | 1 | 1 | 0 | 0 | 268 | 3953.4 |
| $D_A^{\#}$ | 1 | 0 | 0 | 0 | 1 | 1 | 1 | 0 | 0 | 284 | 3730.7 |
| $D_A$ | 1 | 0 | 0 | 1 | 0 | 1 | 1 | 0 | 1 | 301 | 3520.0 |
| $D_G^{\#}$ | 1 | 0 | 0 | 1 | 1 | 1 | 1 | 1 | 1 | 319 | 3321.4 |
| $D_G$ | 1 | 0 | 1 | 0 | 1 | 0 | 0 | 1 | 0 | 338 | 3134.7 |
| $D_F^{\#}$ | 1 | 0 | 1 | 1 | 0 | 0 | 1 | 1 | 0 | 358 | 2959.6 |
| $D_F$ | 1 | 0 | 1 | 1 | 1 | 1 | 0 | 1 | 1 | 379 | 2795.6 |
| $D_E$ | 1 | 1 | 0 | 0 | 1 | 0 | 0 | 1 | 0 | 402 | 2635.6 |
| $D_D^{\#}$ | 1 | 1 | 0 | 1 | 0 | 1 | 0 | 1 | 0 | 426 | 2487.1 |
| $D_D$ | 1 | 1 | 1 | 0 | 0 | 0 | 0 | 1 | 1 | 451 | 2349.3 |
| $D_C^{\#}$ | 1 | 1 | 1 | 0 | 1 | 1 | 1 | 1 | 0 | 478 | 2216.6 |

Oscillation frequency fm = 1059.52KHz

In the column of fm/D there are shown the values obtained by dividing the oscillation frequency of a main oscillation 4 fm=1059.52 KHz by the values of $D_C$ to $D_{C\#}$, respectively. It appears that scale frequencies $C\#_7$ to $C_8$ are generated to such an extent as not to present any problem in practical use.

Figure 2A:
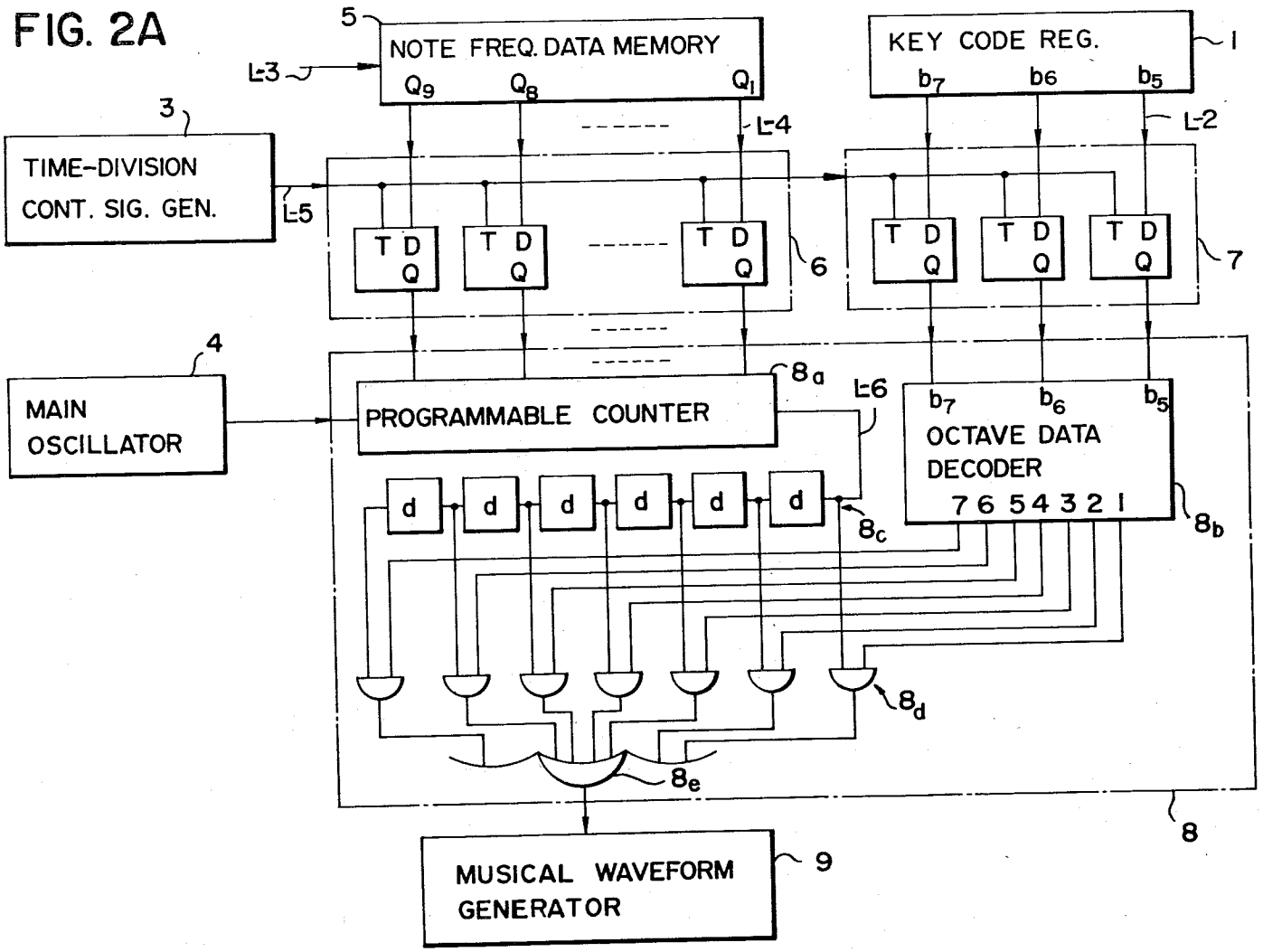
FIG. 2 is a detailed diagram illustrating a frequency generator which forms the principal part of the embodiment depicted in FIG. 1.
Figure 2B:
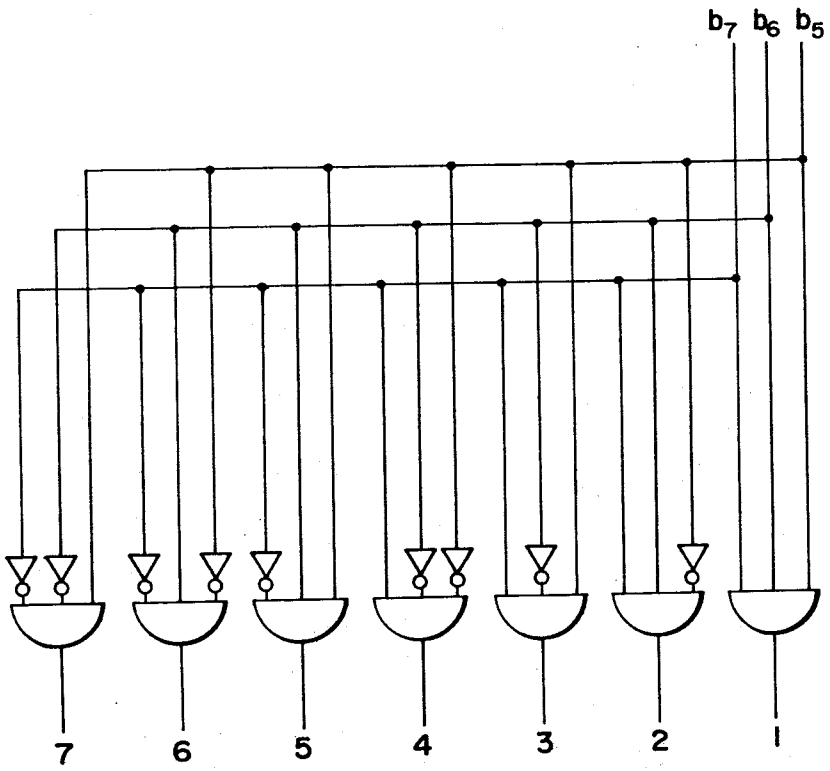

FIG. 2A illustrates in detail the circuit structure for generation of the note frequency from the frequency generator 8. The note frequency data register 6 and the octave data register 7 are each a latch circuit formed with a D type flip-flop, as shown. The D type flip-flops are each supplied at its T terminal with the time division signal provided on the line L-5 from the timing division control signal generator 3. The note frequency data register 6 is supplied at its D terminals with the note frequency data $Q_1$ to $Q_9$ from the note frequency data memory 5 and the scale frequencies $C\#_7$ to $C_8$ corresponding to the latched data $Q_1$ to $Q_7$ are selectively formed by a programmable counter 8*a* and provided on a line L-6. On the other hand, the octave data register 7 is supplied at its D terminals with the key code data $b_5$ to $b_7$ from the key code register 1. An octave data decoder 8*b* can be constructed as depicted in FIG. 2B in accordance with the numerical values shown in Table 3. The scale frequency provided on the line L-6 from the abovesaid programmable counter 8*a* is frequency divided by a ½ frequency divider array 8*c* and those of the outputs from the frequency dividers which correspond to the octave data $b_5$, $b_6$ and $b_7$ stored in the octave data register 7, are selected by an AND gate array 8*d* through the octave data decoder 8*b*. Supplied with the output from the AND gate array 8*d* is an OR circuit 8*e*.

Figure 3A:
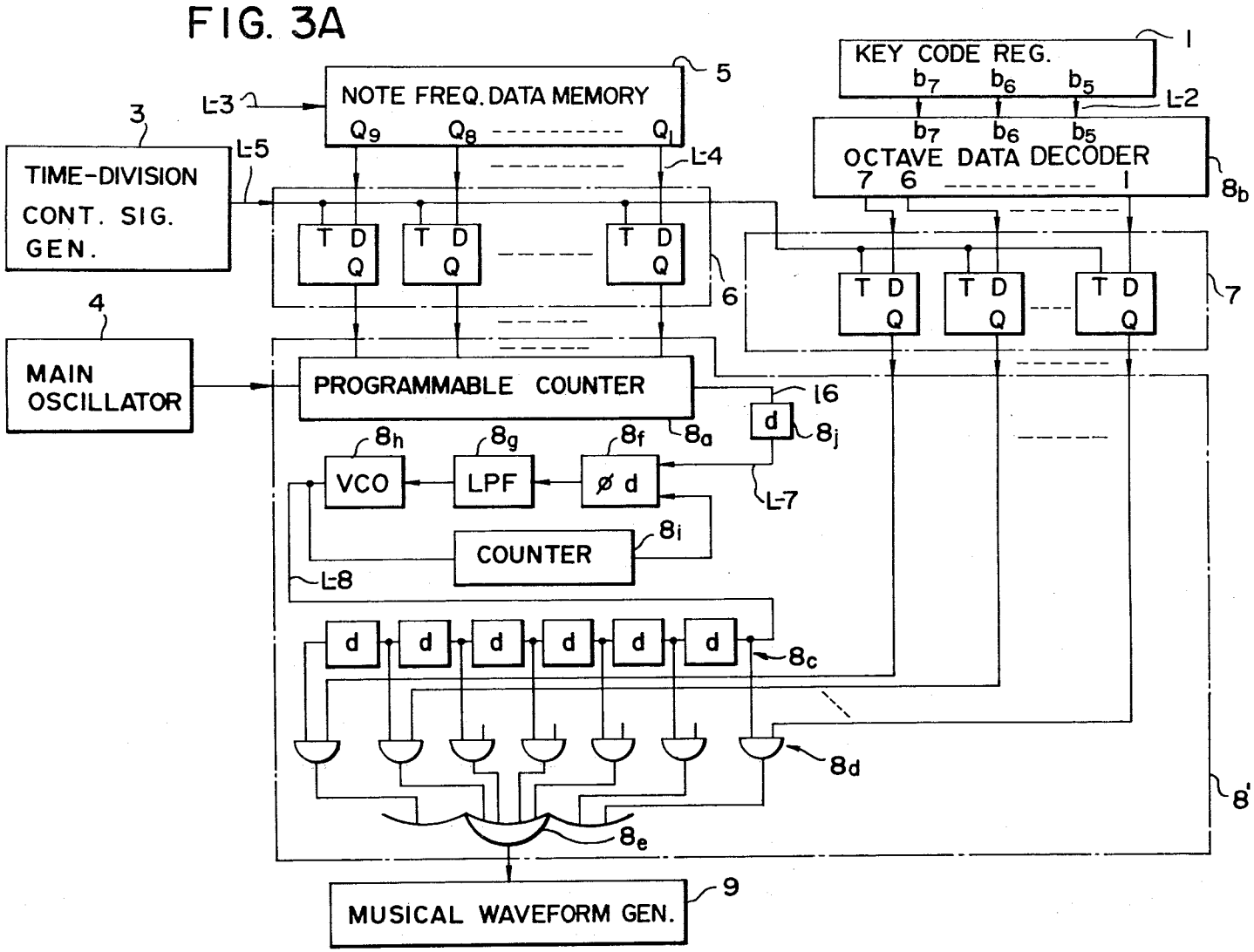
FIGS. 3A and 3B are explanatory diagrams showing another embodiment of this invention.

FIG. 3A shows in detail a frequency generator 8' which generates a frequency N times higher than the note frequency which is required when the musical waveform generator 9 is formed by a memory having stored therein a musical waveform sampled N times. The frequency generator 8' is substantially identical in circuit construction with the circuit of FIG. 2 except for the provision of the octave data decoder 8*b* at the position indicated by the broken line in FIG. 1 so that the output from the octave data decoder 8*b* is loaded in the octave data register 7 to thereby reduce the number of octave data decoders from K to one and for the incorporation of a phase lock loop circuit (hereinafter referred to as the PLL circuit) composed of circuit elements 8*f*, 8*g*, 8*h* and 8*i* and a frequency divider 8*j*. That is, the PLL circuit is a phase lock loop comprising a phase detector 8*f*, a low-pass filter 8*g*, a voltage controlled oscillator 8*h* and a counter 8*i*. The frequency divider 8*j* is provided for producing a symmetrical square wave signal input required by the PLL circuit. In general, the output from the programmable counter is an asymmetric square waveform signal. If the counter 8*i* is formed by an (N+1) step counter in consideration of the frequency divider 8*j*, then there is provided on the line L-8 a frequency N times higher than the frequency on the line L-6. If the programmable counter 8*a* is constructed to output a symmetrical square waveform signal so that the frequency divider 8*j* may be dispensed with the counter 8*i* may be an N-step counter. With such an arrangement, a frequency N times higher than the note frequency is provided on the line L-8. On the other hand, if the note frequency data and the frequency of the main oscillator are selected suitably, the counter 8*i* may be replaced with the programmable counter 8*a*.

Figure 3B:
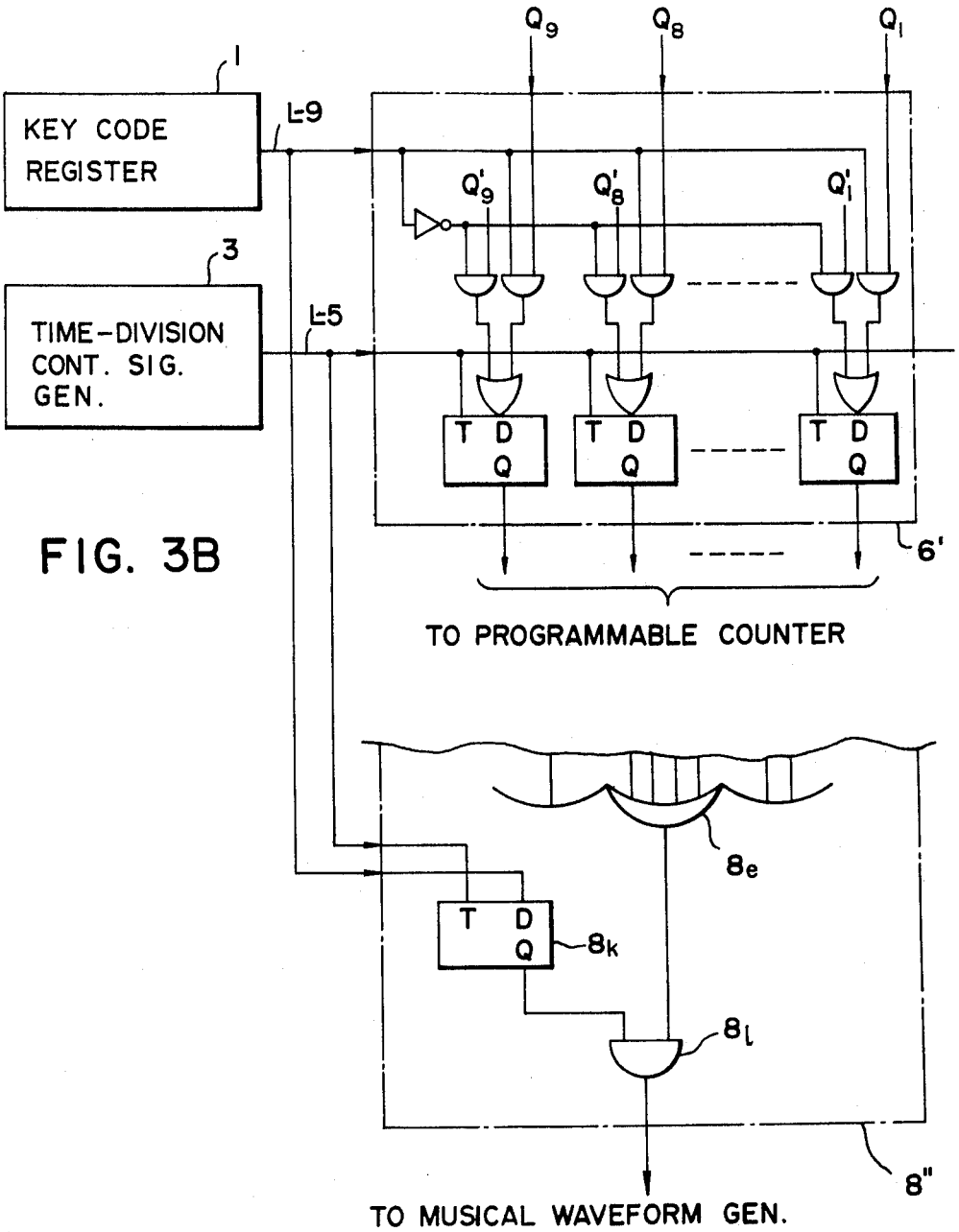

FIG. 3B shows in detail a frequency generator 8" which is additionally provided with a circuit for improving the lock-up time in the case of a change occurring in the input frequency of the PLL circuit. Usually, when the input frequency varies, the PLL circuit requires a certain amount of time to lock up following the input frequency variation. If the input frequency greatly changes, for example, when the frequency on the line L-6 in FIG. 3A varies $C\#_7$ (2216.6 Hz) to $C_8$ (4187.8 Hz), the lock-up time presents a problem in terms of hearing and it is desired to minimize the change in the lock-up time. To this end, it is preferred to lock a frequency of about 3.2 KHz which is intermediate between $C\#_7$ and $C_8$ on the line L-6 even in the case of no address assignment. This causes the lock up to start about 3.2 KHz, so that there will not arise such an extreme case of the lock-up time from $C\#_7$ to $C_8$; thus, eliminating the adverse effect of the lock-up time on the sense of hearing. This is carried out by using a signal provided on line L-9 from the key code register 1 which indicates the presence or absence of address assignment. Namely, the abovesaid signal is applied from the line L-9 directly to that of one of each pair of parallel-connected AND gates in a note frequency date register 6' which receives one of the signals $Q_1$ to $Q_9$ from the note frequency data memory 5 and via a NOT circuit to the other AND gate of each pair which receives one of the signals $Q'_1$ to $Q'_9$, i.e. the note frequency data for generating the frequency 3.2 KHz which is intermediate between $C\#_7$ and $C_8$ thus switching the data to the D terminals of the D type flip-flops. That is, in accordance with Table 3, when tne signal on the line L-9 is "0" in the absence of address assignment, the data $Q_1'$ to $Q_9'$ are applied to the programmable counter 8*a* and, at the same time, the signal on the line L-9 is branched to be stored in the D terminal of the D type flip-flop 8*k*. By the time division signal provided on the line L-9 from the time division control signal generator, the output from the D type flip-flop 8*k* is made "0" to close a gate 8*l*, inhibiting the output from the OR gate 8*e*. If the values of the separately set note frequency data $Q_1'$ to $Q_9'$ are selected to be about 331 in the decimal representation, fm/331-3.2 KHz to provide a desirable frequency and the data $Q_1'$, $Q_3'$, $Q_4'$, $Q_7'$ and $Q_9'$ are "1" and the others are "0", wherein "1" means the connection to the side of the power source and "0" the connection to the side of ground. When the signal on the line L-9 indicates the presence of assignment and is "1", the data $Q_1$ to $Q_9$ are applied to the programmable counter 8*a*, and at the same time, the output from the D type flip-flop 8*k* becomes "L" to open the gate 8*l*, sending out the output from the OR circuit 8*e* to the musical waveform generator 9. With this, in order to improve the lock-up time provided by the separately set note frequency data $Q_1'$ to $Q_9'$, no frequency signal is sent out to the musical waveform generator 9, but instead only the frequency signals yielded by the data $Q_1$ to $Q_9$ is applied to the musical waveform generator 9. On the other hand, the lock-up time to the frequency signals by the data $Q_1$ to $Q_9$ becomes the lock-up time from the frequency signal of 3.2 KHz yielded by the data $Q_1'$ to $Q_9'$, and this presents such an extreme case of a lock-up time from $C\#_7$ to $C_8$.

Figure 5:
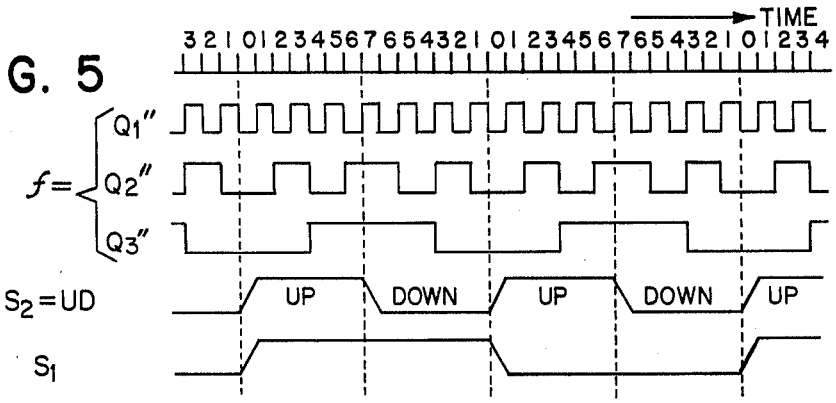
FIG. 5 is a timing chart explanatory of the operation of the embodiment of FIG. 4.
Figure 4:
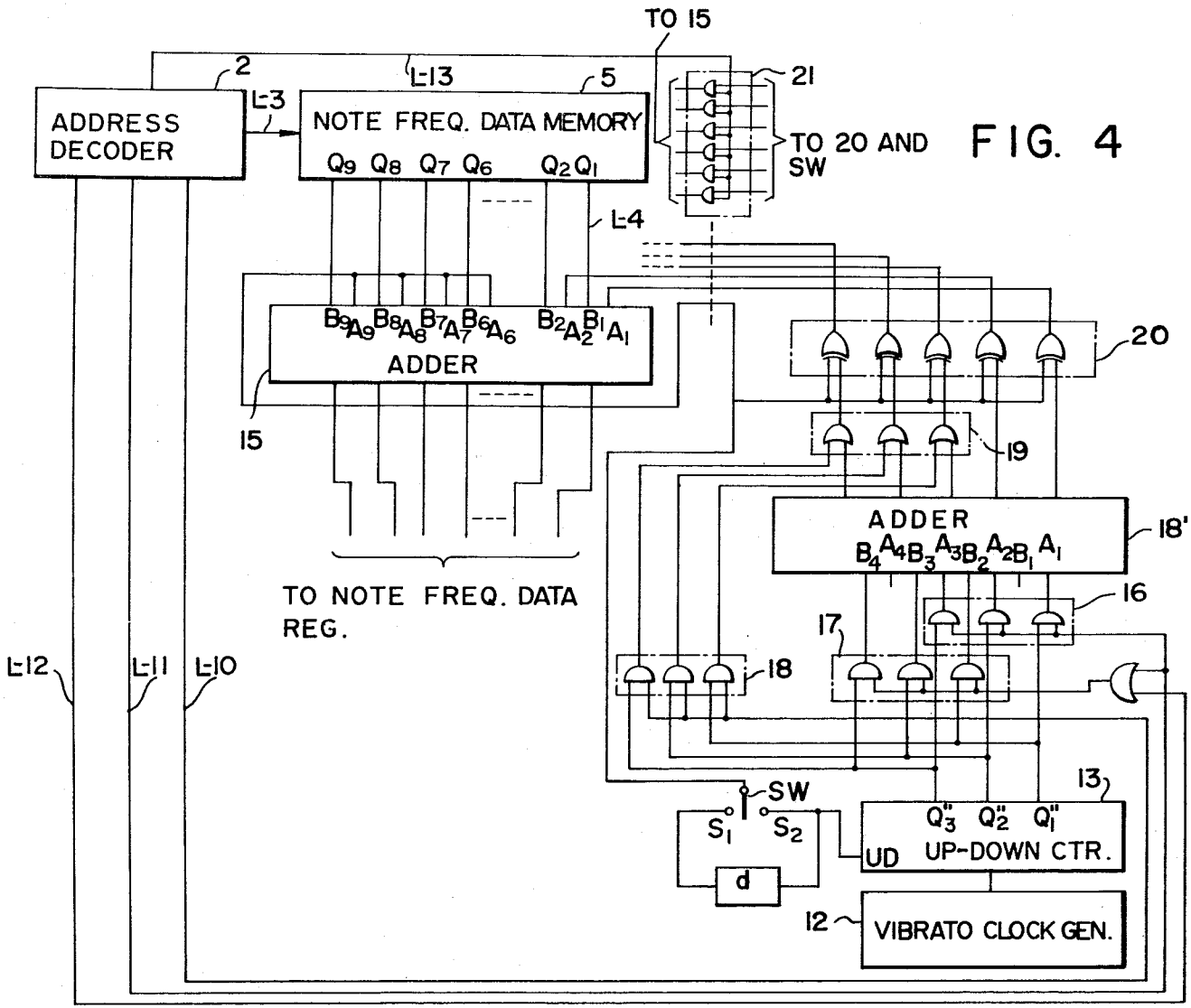
FIG. 4 is an explanatory diagram showing another embodiment of this invention.

FIG. 4 is a circuit diagram illustrating an example of a vibrato addition system. FIG. 5 is a timing chart explanatory of the operation of the principal part of the system shown in FIG. 4. Vibrato is achieved by changing the values of the outputs $Q_1$ to $Q_9$ from the note frequency data memory 5. Since it is desirable that vibrato has substantially a constant depth over the entire sound range, it is preferred that the variation in the outputs $Q_1$ to $Q_9$ is divided into three stages according to the note data. If the variation is selected constant, vibrato becomes deeper with a decrease in the value D in Table 4. For instance, when the variation is $\pm 10$, changes of about $\pm 35$ cents and about $\pm 67$ cents occur in $D_C\#$ and in $D_C$, respectively. Therefore, if the unit amount of the variation is taken as f, $D_C\#$ to $D_D\#$, $D_E$ to $D_G$ and $D_G\#$ to $D_C$ change by 4*f*, 3*f* and 2*f*, respectively, by which can be achieved vibrato which does not present any problem in terms of hearing. The circuit of FIG. 4 is constructed in accordance with the abovesaid principle. That is, a vibrato clock generator 12 generates clock pulses, which are counted by an up-down counter 13 to provide outputs $Q_1''$ to $Q_3''$. If a change in the outputs $Q_1''$ to $Q_3''$ is f(v), gates 16, 17 and 18 correspond to f, 2*f* and 4*f*, respectively. Namely, the address decoder 2 provides a signal "1" on lines $l_{10}$, $l_{11}$ and $l_{12}$ in such a manner as to open the gates 18 in the case of $D_C\#$ to $D_D\#$, the gates 16 and 17 through an OR circuit in the case of $D_E$ to $D_G$ and the gates 17 in the case of $D_G\#$ to $D_C$, respectively. The outputs from the gates 16 and 17 are applied to an adder 18' and then outputted through gates 19 and 20 together with the output from the gates 18. A switch SW is to determine the pattern of the vibrato variation. That is, if the output of an up-down control pulse UD of the up-down counter 13 is connected to one output end $S_1$ of a ½ frequency divider d, the output from the gates 20 are added as two's complements or as they are to the outputs from the note frequency data memory 5 in dependence upon whether $S_1$ is "1" or "0", so that the resulting vibrato variation becomes a chopping wave-like variation and if the abovesaid output is connected to the other output end $S_2$, the output from the gate 20 are added as two's complements or as they are to the outputs from the note frequency data memory 5 so that the resulting vibrato variation becomes a sawtooth wave-like variation. Where it is desired to add the vibrato effect to notes of a particular keyboard, OR gates 21 are inserted at a position indicated by the dashed line and, based on the individual keyboard data of the address decoder 2, a signal "1" is provided on a line L-13 only in the case of the keyboard desired to add the vibrato effect. The depth of vibrato can be adjusted by changing the weighting when the output signals from the gates 20 are added together in the adder 15.

With the present invention, the note frequency data and the octave data corresponding to depressed key switches are applied to frequency generators through registers to provide in respective channels frequencies related to the musical frequencies of the depressed key switches, as described above. This invention has the advantage that a frequency error is difficult to occur. Further, since the circuit structure of this invention is simple and since almost all of the operations can be achieved by digital processing, it is possible to obtain an electronic musical instrument which is easy to integrate and hence is inexpensive.

It will be apparent that many modifications and variations may be effected without departing from the scope of novel concepts of this invention.

What is claimed is:

1. An electronic musical instrument comprising key switches, a key code register coupled to said key switches for providing coded data in response to key switch depression, a note frequency data memory for storing note frequency data corresponding to the coded data from the key code register;

a time division control signal generator for generating a time division pulse;

a note frequency data register for latching and storing the data from the note frequency data memory by the time division pulse whereby the note frequency data memory is used on a time-shared basis;

an octave data register for latching and storing octave data from the key code register by the time division pulse from the time division control signal generator;

a frequency generator composed of a programmable counter supplied with the output from the note frequency data register to provide a generator frequency corresponding thereto, a frequency divider array having a plurality of output ends and supplied with said generator frequency, and a decoder supplied with the output from the octave data register, the outputs from the respective output ends of the frequency divider array being selected by the output from the decoder in accordance with the octave data, to produce a frequency generator output, and a musical waveform generator composed of filter circuits corresponding to respective musical instrument sounds and supplied with the output from the frequency generator to provide a musical signal.

2. An electronic musical instrument comprising key switches, a key code register coupled to said key switches for providing coded data in response to key switch depression, a note frequency data memory for storing note frequency data corresponding to the coded data from the key code register;

a time division control signal generator for generating a time division pulse;

a note frequency data register for latching and storing the data from the note frequency data memory by the time division pulse from the time division control signal generator;

an octave data register for latching and storing octave data from the key code register by the time division pulse from the time division control signal generator;

a frequency generator composed of a programmable counter receiving the output from the note frequency data register to provide a generator frequency corresponding thereto, a frequency divider array having a plurality of output ends and supplied with said generator frequency, and a decoder supplied with the output from the octave data register, the outputs from the respective output ends of the frequency divider array being selected by the output from the decoder in accordance with the octave data to produce a frequency generator output;

a musical waveform generator composed of wave generator circuits and supplied with the output from the frequency generator to provide an analog signal; and a phase lock loop circuit inserted between the programmable counter and the frequency divider array for multiplying said generator frequency a predetermined amount, a selector circuit in said note frequency data register responsive to an address assignment part of the coded data from the key code register for supplying the note frequency data from the note frequency data memory or a separate fixed note frequency data to the programmable counter depending upon the presence of absence of the address assignment, thereby to improve the lock-up time of the phase lock loop circuit when the address assignment part of the coded data changes.

3. An electronic musical instrument comprising:

key switches, a key code register coupled to said key switches for providing coded data in response to key switch depression, a note frequency data memory for storing note frequency data corresponding to the coded data from the key code register;

a time division control pulse generator for generating a time division pulse, a note frequency data register for latching and storing the data from the note frequency memory by the time division pulse from the time division control signal generator;

an octave data register for latching and storing octave data from the key code register by the time division pulse from the time division control signal generator;

a frequency generator composed of a programmable counter supplied with the output from the note frequency data register to provide a generator frequency corresponding thereto, a frequency divider array having a plurality of output ends and supplied with said generator frequency, and a decoder supplied with the output from the octave data register, the outputs from the respective output ends of the frequency divider array being selected by the output from the decoder in accordance with the octave data to provide a frequency generator output;

a musical waveform generator composed of wave generating circuits corresponding to respective musical instrument sounds and supplied with the output from the frequency generator to provide an analog signal;

a vibrato oscillator, and a vibrato generator comprising an up-down counter supplied with the output from the vibrato oscillator and producing an output f, the up-down counter further providing the outputs 2f and 4f, dividing means for dividing the output frequency data from the note frequency data memory into a plurality of groups of adjoining notes, adder means for taking one or more of the outputs f, 2f and 4f and adding it to or subtracting it from the output from the note frequency data memory to produce a vibrato effect to the note frequency data, the note frequency data with the vibrato effect being applied to the programmable counter of the frequency generator by means of the note frequency data register.

* * * * *